US006289854B1

(12) United States Patent
Holmström et al.

(10) Patent No.: US 6,289,854 B1
(45) Date of Patent: Sep. 18, 2001

(54) METHOD AND ARRANGEMENT RELATING TO CIRCULATION PUMPS

(75) Inventors: Jan Christian Holmström, Göteborg; Sassan Etemad, Västra Frölunda; Arne Andersson, Mölnlycke, all of (SE)

(73) Assignee: Volvo Lastvagnar AB, Gothenburg (SE)

( * ) Notice: Subject to any disclaimer, the term of this patent is extended or adjusted under 35 U.S.C. 154(b) by 0 days.

(21) Appl. No.: 09/424,672

(22) PCT Filed: May 28, 1998

(86) PCT No.: PCT/SE98/01014

§ 371 Date: Nov. 29, 1999

§ 102(e) Date: Nov. 29, 1999

(87) PCT Pub. No.: WO98/54448

PCT Pub. Date: Dec. 3, 1998

(30) Foreign Application Priority Data

May 29, 1997 (SE) ..... 9702021-8

(51) Int. Cl.[7] ..... F01P 5/10

(52) U.S. Cl. ..... 123/41.44; 123/41.09

(58) Field of Search ..... 123/41.08, 41.09, 123/41.1, 41.44, 41.54; 415/116, 117, 202, 206, 204; 417/423.1

(56) References Cited

U.S. PATENT DOCUMENTS 3,162,136 12/1964 Clary et al. ..... 415/203
3,877,835 * 4/1975 Siptrott ..... 415/143
4,352,342 * 10/1982 Cser et al. ..... 123/41.54
4,382,746 * 5/1983 Retz ..... 415/202
4,620,509 * 11/1986 Crofts ..... 123/41.1
5,241,926 * 9/1993 Sato et al. ..... 123/41.54
6,074,554 * 6/2000 Ray et al. ..... 210/194

FOREIGN PATENT DOCUMENTS 261474 11/1949 (CH) .
1379562 1/1964 (FR) .

* cited by examiner

*Primary Examiner*—Noah P. Kamen
*Assistant Examiner*—Hai Huynh
(74) *Attorney, Agent, or Firm*—Burns, Doane, Swecker & Mathis, L.L.P.

(57) ABSTRACT

A circulation pump for pumping a fluid, for example for heat interchange, by way of a rotating impeller is included in a circulation system that includes a first feeder liner from a heat source to a cooling device, a return line from the cooling device to the pump and a valve for shunting the outflow from the heat source via a bypass line back to the pump. The bypass line is connected to the pump in such a way that a flow essentially from this line produces and/or increases a pre-rotation of the inflow to the impeller, which pre-rotation results in a reduction of the power required by the engine.

16 Claims, 5 Drawing Sheets

METHOD AND ARRANGEMENT RELATING TO CIRCULATION PUMPS

TECHNICAL FIELD

Figure 1:
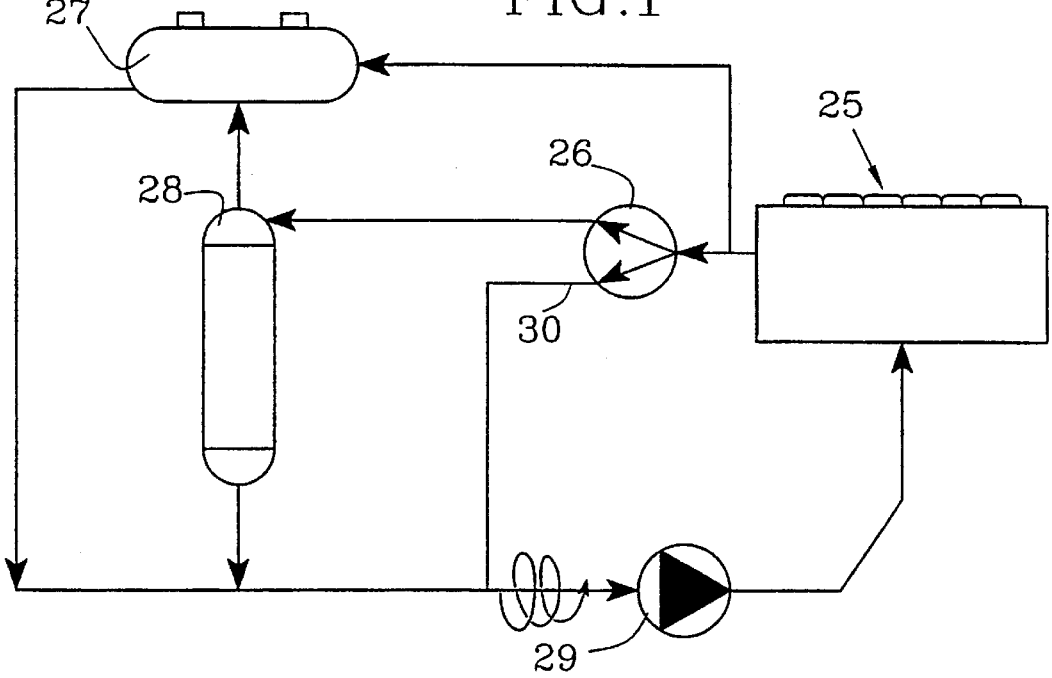

The present invention refers to a circulation pump for pumping a cooling medium by means of a rotating impeller, for instance for cooling a vehicle's engine, which pump is a part of a cooling system including a feeder line from the engine to a radiator, a return line from the radiator to the pump and a control valve for shunting the outflow from the engine via a bypass line back to the pump with respect to the operation condition of the engine, whereby an inlet is directed towards the centre of the impeller and a spiral-shaped outlet extends from the outer edge of the impeller.

BACKGROUND OF THE INVENTION

In a conventional cooling system, for example in a vehicle, the cooling medium pump for cooling the engine is operated in such a way that the flow varies depending on the engine speed. The control valve is used to control the flow of the pump, either to the radiator or back to the pump depending on the temperature of the flow, which leaves the engine. The capacity of the flow in a conventional system is dimensioned to manage engine operation under full load conditions, such as driving in an upward slope with a full throttle. Normally, the bypass line is also dimensioned for approximately the same amount of flow, which flows through the radiator so that the thermostat control can be as efficient as possible.

Accordingly, the flow capacity is not optimized for normal operation conditions, which means that the pump operates with high effect independent of the operation conditions. Consequently, the operation of the cooling medium pump results in considerable power dissipation, which effects the engine efficiency.

It is desirable to reduce this power dissipation without influencing the construction in a negative way, for example, avoiding that it becomes more bulky or considerably expensive to produce.

The Technical Problem

The object of the present invention is to provide a circulation pump, which solves the above-mentioned problems.

The Solution

For this purpose, the invention features a bypass line connected to the pump in such a way that a flow through this line produces and/or increases a pre-rotation of inflow to the impeller, resulting in a reduction of the power required by the engine. By providing this bypass flow the efficiency of the pump increases as long as some part of the coolant passes through the bypass line.

According to an advantageous embodiment of the invention the bypass flow is conducted into the pump via a passage, which is substantially tangentially connected to a central pump inlet.

Preferably, the passage includes a curved outer wall surface with a cross section area that reduces monotonously in direction of the central pump inlet.

The passage can thereby extend helically around the central inlet.

Suitably the passage forms an area reduction, which allows the flow from the bypass line, essentially tangentially increase the flow speed in the direction of the inlet.

In an embodiment, at least one inlet is directed to the centre of the impeller and the bypass line extends at least partly spiral-wounded around the inlet and the bypass line branches.

In another suitable embodiment an inlet extends partly in the bypass line and is directed towards the centre of a device equipped with a blade which has an opening, which device essentially tangentially directs the flow from the bypass line towards the flow from the inlet through said opening and produces a pre-rotation. The device provided with the blade is arranged essentially in the flow from the bypass line immediately before the impeller.

In the preferred embodiments the pre-rotation is in the direction of the impeller's rotation.

The invention also refers to a cooling medium pump for pumping a cooling medium by means of a rotating impeller, for instance to cool a vehicle's engine, which pump is included in a cooling system including a feeder line from the engine to a radiator, a return line from the radiator to the pump and a valve for shunting the outflow from the engine via a bypass line back to the pump. The bypass line is connected to the pump in such way that a flow, essentially from this line, results in and/or increases a pre-rotation of inflow to the impeller, which pre-rotation results in a reduction of the power required by the engine. In the cooling medium pump, the flow depends on the operation conditions of the engine. Preferably the valve is thermostat-controlled.

According to a method of the invention, for optimizing the flow capacity in a circulation pump for pumping a cooling medium by means of a rotating impeller, for instance for cooling a vehicle's engine, which pump is part of a circulation system including a feeder line from the engine to a radiator, a return line from the radiator to the pump and a control valve for shunting the outflow from the engine via a bypass line back to the pump, depending on the operation condition of the engine, an inlet is directed towards the centre of the impeller and a helical outlet extends from the outer edge of the impeller, characterized by the bypass flow essentially from the bypass line encountering the central inlet flow from the inlet, essentially in such a way that a rotation of the inlet flow is produced and the bypass flow meets the inlet flow essentially tangentially.

SHORT DESCRIPTION OF THE DRAWINGS

Figure 2:
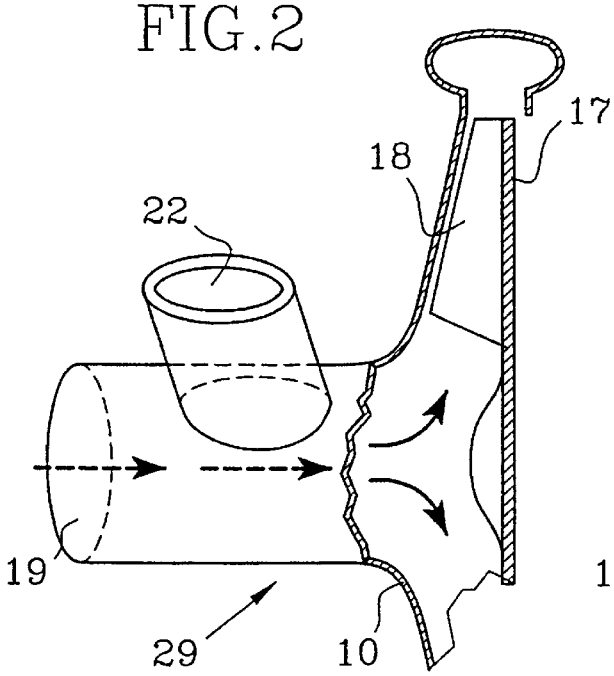
Figure 3:
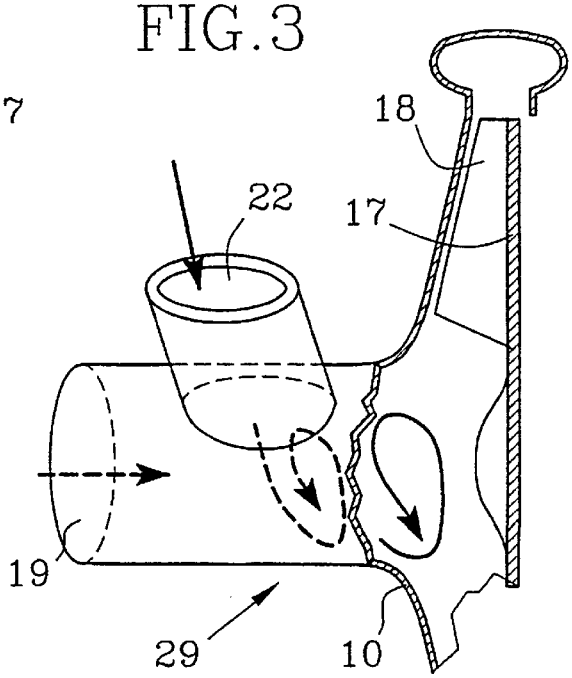
Figure 4:
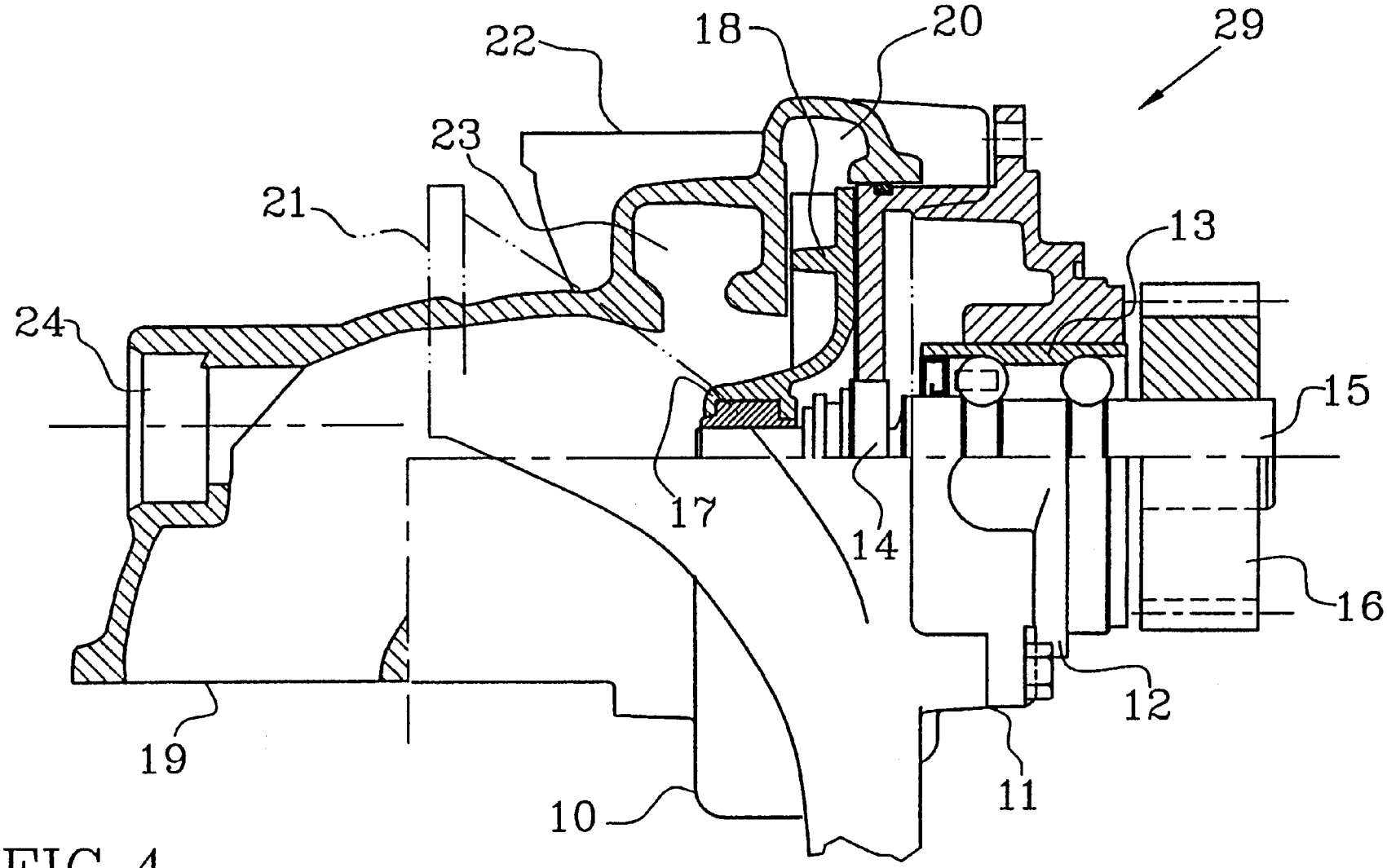
Figure 5:
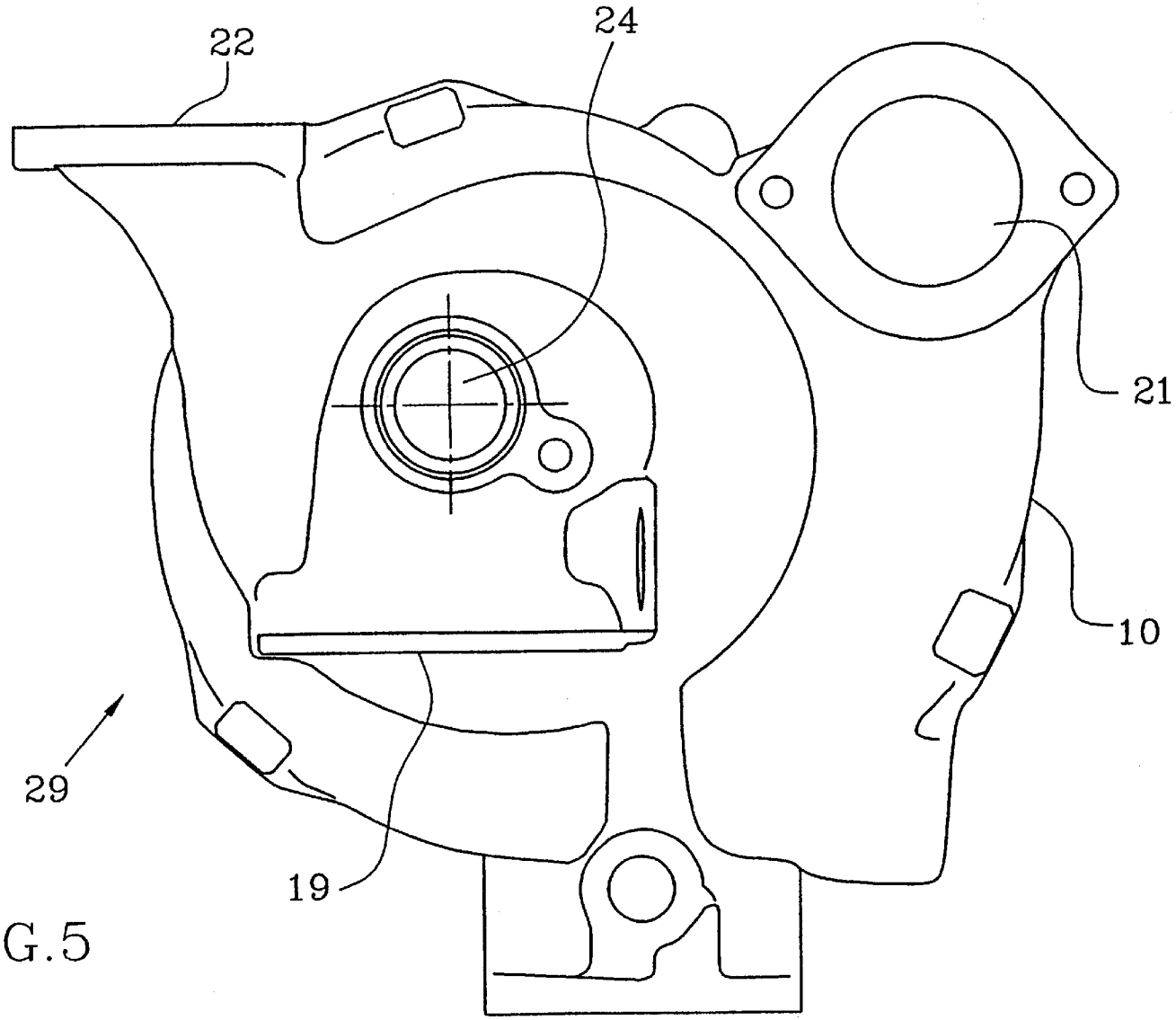
Figure 6:
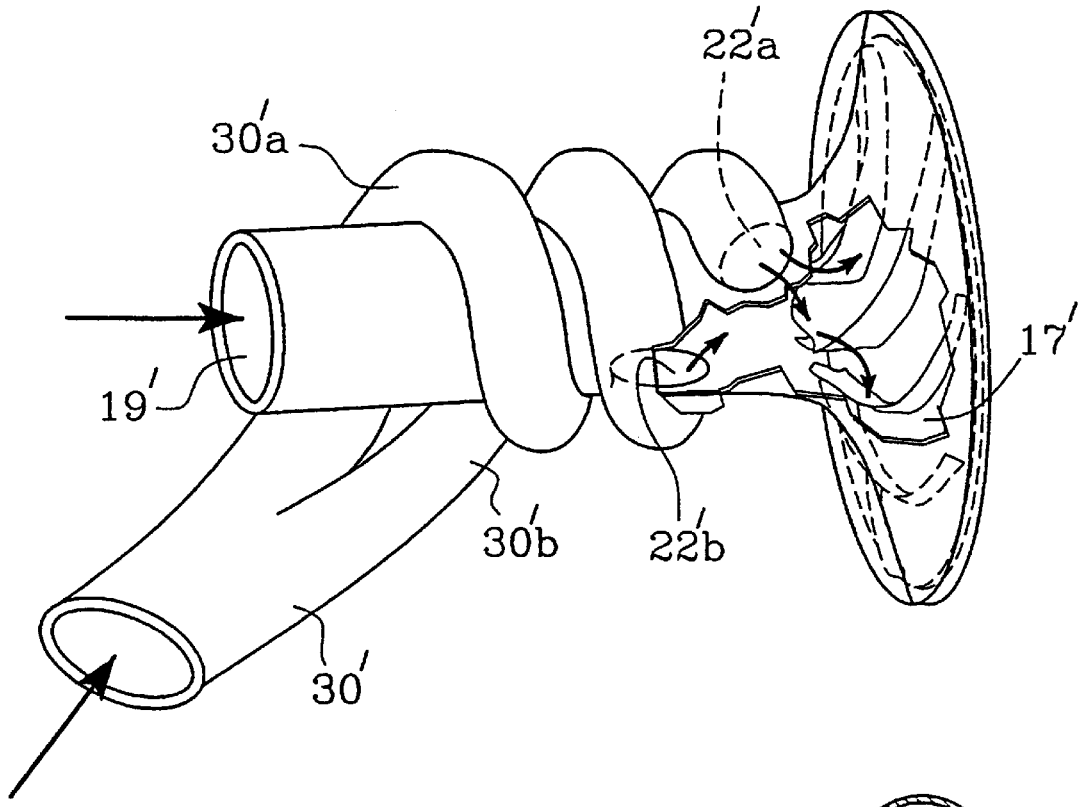
Figure 7:
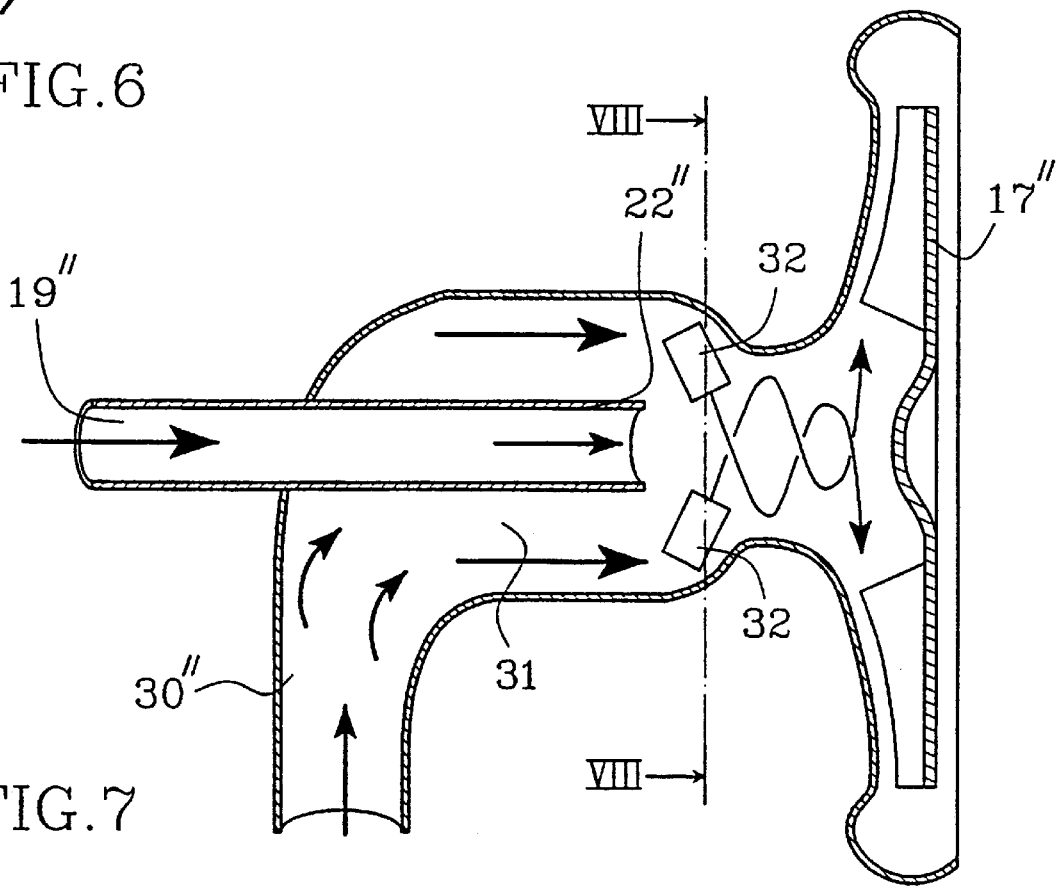
Figure 8:
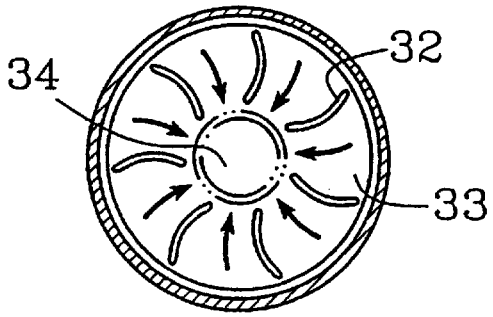
Figure 9:
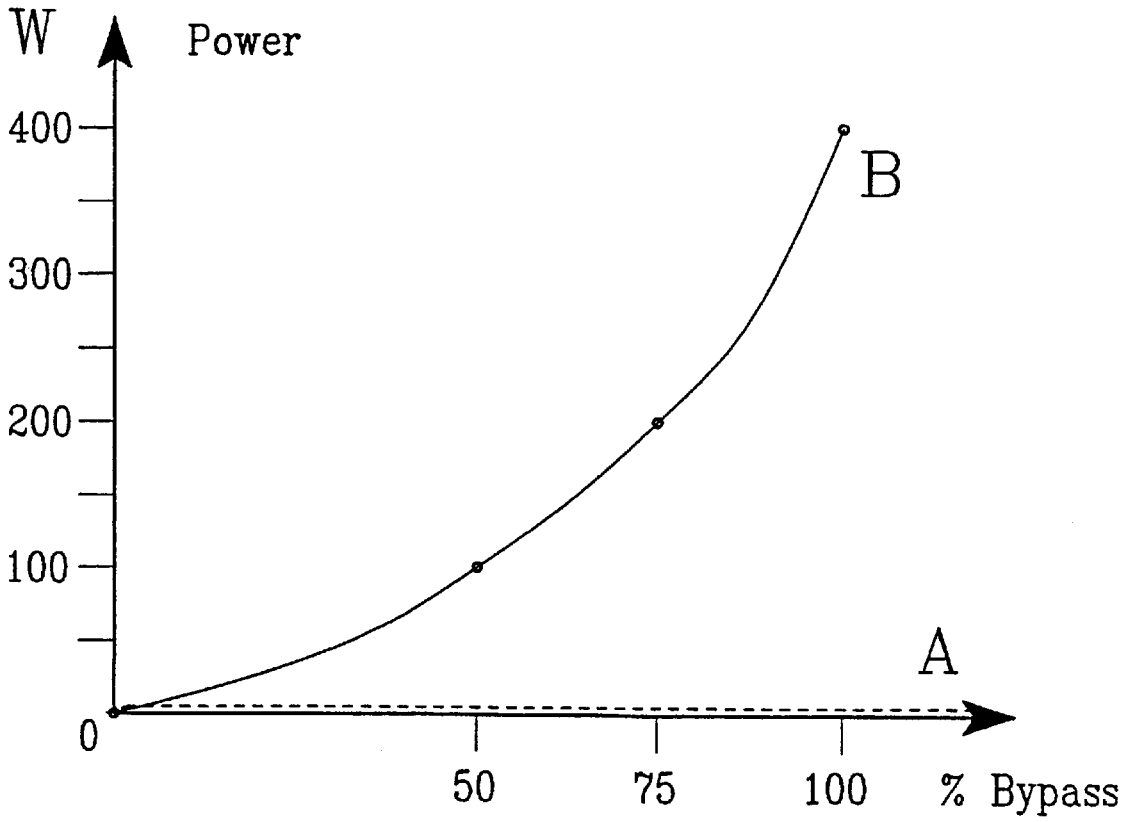

The invention will be described in the following with reference to embodiments illustrated on the enclosed drawings, on which FIG. 1 is a schematic view of the cooling medium system in a vehicle, FIGS. 2 and 3 are schematically and partly in perspective, a cross-section through a circulation pump, intended to illustrate the principle for obtaining a pre-rotation, according to the present invention in a circulation pump, FIG. 4 shows a side elevation view of a more detailed and according to invention designed circulation pump, partly in sections, FIG. 5 is a bottom view of the pump shown in FIG. 4, FIG. 6 shows another embodiment of a pump, according to the invention with a part of the pump house removed and partly transparent, FIG. 7 shows a cut through an alternative embodiment of a circulation pump, according to the invention, FIG. 8 is a cut along line VIII—VIII in FIG. 7, and FIG. 9 is a diagram showing the power/flow relationship.

DESCRIPTION OF THE EMBODIMENTS

The invention primarily aims to obtain a pre-rotation in a circulation pump. Although, in the following description references are made to an embodiment based on a circulation pump in connection with an engine and in particular a vehicle's engine, it is appreciated by a skilled person that the principle according to the present invention can be applied to all types of circulation pumps, where a combination of a first and a second flow is used to achieve a pre-rotation.

FIG. 1 shows a block diagram over a cooling system in a vehicle, which mainly includes an engine 25, primary control valve 26 controlled by a thermostat, possible expansion tank 27, radiator 28, circulation pump 29 and a bypass line 30. Obviously, other parts not important to the invention may be present, which are not excluded in the following description.

The thermostatic controlled valve 26 has a first and a second extreme position as well as a number of intermediate positions. In the first position, it conducts flow via the radiator 28 to the pump 29 and in the second position it conducts flow via a bypass line 30 to the pump 29. These two positions are generally determined based on the temperature of the medium flow in the cooling system, for example during cold days, the cooling medium at the start is circulated first via the bypass line 30 until a certain temperature is reached, the n th e medium is conducted through the radiator 28. Specially, in the present vehicles which generally have a good engine-cooling the flow passes via the bypass line during 90% of time.

FIGS. 2 and 3 show very schematically the basic principle of the invention. Generally, the pump 29 includes a housing 10, impeller 17, impeller blades 18, a first inlet 19, a second inlet 22 and an outlet, which is not shown. The inlet 19 is connected to the radiator while the inlet 22 is arranged essentially just before the impeller 17 and connected to the bypass line 30. In FIG. 2 only one flow into the pump from the radiator is shown, while in FIG. 3 the flow from the bypass line 30 via the inlet 22 is shown, which provides a direction of the bypass flow so that the flow encounters the central inlet flow essentially tangentially. This results in a pre-rotation in the rotation direction of the impeller. The result of this directed inflow is that, as soon as a partial flow is directed by the control valve to the bypass line, the load on the drive-shaft of the pump is reduced because of the impulse moment in the pre-rotation. The load on the drive-shaft of the pump increases naturally in a ratio, which corresponds to the amount of the cooling medium, which passes through the bypass line.

A more detailed embodiment of a circulation pump 29, according to the invention is shown in FIG. 4 and 5. The circulation pump includes a first house half 10 containing the flow channels of the pump. A parting line 11 is common for a second house half 12, containing bearing 13 and packing 14 for a drive-shaft 15.

The right outer end of the drive-shaft in FIG. 4 exhibits a driving wheel 16, for example a toothed belt-drive or a gear in driving relation to an engine. The opposite end of the drive-shaft 15 extends into the first house half 10 and supports an impeller 17 having blades 18.

A first central pump inlet 19 forms a curved flow channel in direction of the centre of the impeller 17 and via a pipeline is connected to a radiator (not shown) being part of the cooling system. In a conventional way, the rotating impeller blades drive the cooling liquid to flow from the inlet side of the pump resulting in the increase of flow speed and pressure along a helical channel 20 having monotonously increased cross section area from the centre of the pump out to an outlet 21. The outlet is connected to the cylinder block of the engine.

Another pump inlet 22 is connected to the bypass line of the cooling system, which extends to the control valve for shunting the engine outflow back to the pump.

The control valve 26 (FIG. 1) is included in the system, which connects the outlet of the cooling channel in the engine to the radiator of the cooling system. The pump inlet 22 transforms into a helical channel 23, which extends with a monotonously shrinking cross section area in the direction of the central pump inlet 19 and parallel to the channel 20. The channel 23 joins the central pump inlet 19, essentially just before the impeller 17 and directs the bypass flow, so that the flow encounters the central inlet flow essentially tangentially with an appreciable force.

In the way as above, this directed inflow to the impeller 17 results in reduction of the drive-shaft 15 of the pump as soon a partial flow is guided by the control valve to the bypass line. Obviously, the load on the drive-shaft 15 of the pump decreases in proportion to the amount of coolant which passes through the bypass line. When the flow through the bypass line is, for example zero or close to zero, i.e. when the engine operates under ful load conditions, the pump functions as a conventional cooling medium pump.

The inlet 19 includes a branch joint 24, which connects the pump to the expansion tank 27 for coolant and has the function of pressurising the cooling system. The branch joint is located in alignment with the rotation axis of the impeller, where the pressure is low. As an alternative to the shown design of the branch joint, the joint extends with a tube connection piece a bit into the pump and provides better pressurization, Another embodiment of the invention is shown schematically in FIG. 6, where the pre-rotation is created by conducting the flow through the bypass line 30', which is "twined" in arbitrary numbers around the inlet 19' essentially axially directed towards the centre of the impeller. The line 30' branches in two branches 30'*a* and 30'*b* and discharges into the pump inflow via two inlets 22'*a* and 22'*b,* respectively, essentially tangential manner directed towards the flow from the inlet 19'. Obviously, one or more branches of the bypass line and one or more inlets thereof can be provided. The diameter of the branched lines can also vary, preferably monotonously decreasing towards the inlet 22'*a* and 22'*b,* respectively.

In yet another embodiment, which is shown in FIG. 7, one part of the inlet 19" is introduced into the bypass line 30", as a short connection piece 31. Just before the impeller 17", a drum 33 provided with blades 32 is arranged, a cut through which is shown in FIG. 8. The drum 33 in its centre is arranged with an opening 34 through which flow into the impeller 17" passes. The connection piece 31 is provided to direct a flow mainly to the open centre of the drum 33 inside the blade's inner terminating borderline, while the flow from the bypass line 30" encounters the blades 32 and due to the blades curved and towards the centre of the drum 33 inclining shape, an essentially tangential flow is directed towards the flow from the inlet 19" and causes a pre-rotation.

The embodiment according to this example can of course be modified by altering the place of the bypass line and the inlet according to FIG. 7. In this case, the drum provided with the blades must be arranged in the centre, for example inside or immediately outside the discharge of the bypass flow line so that the flow is directed tangentially out towards the flow from the inlet.

In a vehicle, the gain of having a device at the circulation pump according to the invention depends on the ratio of a driving cycle, in which the engine runs with a partial load and full load, respectively. Practical experiments have shown that the fuel saving during a normal driving cycle can, for example be up to about 5 percent, by using the circulation pump according to the invention.

The diagram of FIG. 9 shows schematically and as an example the gain of using the pre-rotation according to invention. The horizontal axis of the diagram represents the percentage of the bypass flow and the vertical axis shows the power. Graph A shows that the power is zero or essentially near 0 W when no pre-rotation is used. On the other hand, graph B shows the power with regard to the bypass flow when pre-rotation is used. It is apparent from the drawing that at 100% flow through the bypass line, an effect of 400 W is obtained.

In a conventional cooling system the bypass channel is dimensioned through throttling for a fall of pressure corresponding to the fall of pressure through the radiator, so that the control valve is able to control its inflow in direction towards two equivalent flow paths. Consequently, the pump operates with the same load and the cooling liquid flows either through the radiator or through the bypass line. By the design of the circulation pump, according to the present invention, this throttling can be arranged inside the pump in such a way that the acceleration of the speed of the flow is used to reduce the power requirement.

In some cooling medium pumps the flow from the radiator is discharged into the pump house so that it creates a pre-rotation and the pump works normally with pre-rotation. In such a pump the flow from the bypass line can increase the existing pre-rotation, or at no flow from the radiator results in an increased pre-rotation.

However, the inlet flow does not need to be axially directed towards the impeller, but can partly be tangentially directed towards the impeller. In this case, the flow from the bypass line is directed towards the inlet flow in such a way that it increases the pre-rotation.

The invention is not limited to the above described embodiments, and several modifications are conceivable within the scope of the attached claims. For instance, the inlet and outlet of the pump can be arranged in other ways.

DESIGNATION SIGNS

10 First pump house half
11 Parting line
12 Second pump house half
13 Bearing
14 Packing
15 Drive-shaft
16 Driving wheel
17 Impeller
18 Impeller blades
19 Pump inlet
20 Channel
21 Outlet
22 Pump inlet
23 Channel
24 Branch connection
25 Engine
26 Control valve
27 Expansion tank
28 Radiator
29 Pump
30 Bypass line
31 Connection piece
32 Blade
33 Drum
34 Opening

What is claimed is:

1. A circulation pump in a fluid circulation system comprising a first feeder line from a heat source to a cooling device, a return line from the cooling device to the pump and a valve for shunting flow from the heat source via a bypass line back to the circulation pump, the circulation pump comprising:

a housing;

a first inlet;

a rotating impeller inside the housing; and a second inlet connected to the bypass line so that a flow from the bypass line produces and/or increases a pre-rotation of the fluid flow directed towards the impeller.

2. The circulation pump according to claim 1, wherein the first inlet of the pump is directed towards a center of the impeller and an outlet of the pump extends from an outer edge of the impeller.

3. The circulation pump according to claim 1, wherein the first inlet is essentially tangentially connected to the first inlet.

4. The circulation pump according to claim 3, wherein the second inlet is formed with a curved outer wall surface having a cross section area decreasing monotonously in a direction of the first inlet.

5. The circulation pump according to claim 3, wherein the second inlet extends helically around the first inlet.

6. The circulation pump according to claim 3, wherein the second inlet comprises an area reduction, which increases flow from the bypass line tangentially in the direction of the first inlet.

7. The circulation pump according to claim 1, wherein at least the first inlet is directed towards a center of the impeller and the bypass line extends at least partly helically around the first inlet.

8. The circulation pump according to claim 7, wherein the bypass line is branched off.

9. The circulation pump according to claim 1, wherein a portion of the first inlet extends inside the bypass line and is directed towards a center of a device arranged with a blade including an opening, said device directing a flow from the bypass line essentially tangentially towards the flow from the first inlet through said opening.

10. The circulation pump according to claim 9, wherein the device is provided with plural blades and is arranged in the flow from the bypass line adjacent the impeller.

11. The circulation pump according to claim 1, wherein the pre-rotation is in a direction of rotation of the impeller.

12. In a cooling system for cooling a combustion engine of a vehicle, a cooling medium pump for pumping a cooling medium, the cooling system comprising a feeder line from an engine to a radiator, a return line from the radiator to the pump, a valve for shunting outflow from the engine via a bypass line back to the pump, and means connected to said engine for operating said pump consuming an amount of power, said pump comprising:

a housing;

a first inlet;

a rotating impeller inside said housing; and a second inlet connected to the bypass line so that a flow from the bypass line produces and/or increases a pre-rotation of fluid flow towards the impeller to reduce the power from the engine.

13. The cooling medium pump according to claim 12, wherein the flow depends on the engine operation condition.

14. The cooling medium pump according to claim 12, wherein the valve that is thermostat-controlled.

15. A method for optimizing flow capacity in a circulation pump for pumping a cooling medium by way of a rotating impeller, which pump is included in a circulation system including a feeder line from an engine to a radiator, a return line from the radiator to the pump and a control valve for shunting outflow from the engine via a bypass line back to the pump, with respect to operation conditions of the engine, the pump including an inlet directed towards a centre of the impeller and a spiral-shaped outlet extending from an outer edge of the impeller, the method comprising arranging the bypass flow essentially from the bypass line so that the bypass flow meets a central inlet flow from the inlet to produce and/or increase a rotation of the inlet flows.

16. The method according to claim 15, wherein the bypass flow meets the inlet flow essentially tangentially.

* * * * *